US009930939B2

(12) United States Patent
Keyaki et al.

(10) Patent No.: US 9,930,939 B2
(45) Date of Patent: Apr. 3, 2018

(54) SLIDER FOR SLIDE FASTENER

(75) Inventors: Keiichi Keyaki, Toyama (JP); Yuuichi Miyazaki, Toyama (JP); Shinya Honda, Toyama (JP)

(73) Assignee: YKK Corporation (JP)

( * ) Notice: Subject to any disclaimer, the term of this patent is extended or adjusted under 35 U.S.C. 154(b) by 322 days.

(21) Appl. No.: 14/399,490

(22) PCT Filed: May 8, 2012

(86) PCT No.: PCT/JP2012/061754
§ 371 (c)(1),
(2), (4) Date: Nov. 6, 2014

(87) PCT Pub. No.: WO2013/168231
PCT Pub. Date: Nov. 14, 2013

(65) Prior Publication Data
US 2015/0113771 A1 Apr. 30, 2015

(51) Int. Cl.
*A44B 19/26* (2006.01)

(52) U.S. Cl.
CPC ..... *A44B 19/26* (2013.01); *A44B 19/262* (2013.01); *Y10T 24/2582* (2015.01); *Y10T 24/2584* (2015.01)

(58) Field of Classification Search
CPC .... A44B 19/26; A44B 19/262; Y10T 24/2561
USPC ..... 24/428
See application file for complete search history.

(56) References Cited

U.S. PATENT DOCUMENTS 3,823,446 A * 7/1974 Labecki ..... A44B 19/303 24/418
4,455,722 A * 6/1984 Oda ..... A44B 19/26 24/415
4,562,622 A * 1/1986 Takabatake ..... A44B 19/26 24/415

(Continued)

FOREIGN PATENT DOCUMENTS

EP 2322050 A1 5/2011
GB 42744 A 4/1935

(Continued)

OTHER PUBLICATIONS

International Search Report, PCT Application No. PCT/JP2012/061754, dated Aug. 14, 2012.

(Continued)

*Primary Examiner* — Jason W San
(74) *Attorney, Agent, or Firm* — Kilpatrick Townsend & Stockton LLP

(57) ABSTRACT

A slider includes lower flanges placed on left and right side edges of a lower wing plate. Each of the lower flanges includes a downwardly inclined surface portion which is placed on the shoulder-opening-side tip portion on a side of its upper surface and on an outer side in a width direction of the slider, and which downwardly inclines toward a shoulder and downwardly inclines toward the outer side in the width direction of the slider. According to this, in a slide fastener having the slider, even if a sliding operation of the slider is repeated in the slide fastener, it is possible to avoid defects that the lower flange of the slider comes into sliding contact with the fastener tape and the fastener tape is broken, and it is possible to extend the life of the fastener tape.

8 Claims, 8 Drawing Sheets

(56) References Cited

U.S. PATENT DOCUMENTS

| | | | | |
|---|---|---|---|---|
| 5,991,981 | A * | 11/1999 | Komuro | A44B 19/26 24/418 |
| 8,056,194 | B2 * | 11/2011 | Miyazaki | A44B 19/26 24/387 |
| 9,687,050 | B2 * | 6/2017 | Lin | A44B 19/26 |
| 2008/0034559 | A1 * | 2/2008 | Tachi | A44B 19/26 24/427 |
| 2010/0154179 | A1 * | 6/2010 | Blackford | A44B 19/26 24/399 |
| 2010/0242237 | A1 * | 9/2010 | Lin | A44B 19/26 24/430 |
| 2012/0124788 | A1 * | 5/2012 | Keyaki | A44B 19/382 24/386 |
| 2012/0151719 | A1 * | 6/2012 | Keyaki | A44B 19/26 24/427 |
| 2014/0041162 | A1 * | 2/2014 | Keyaki | A44B 19/26 24/403 |
| 2017/0164696 | A1 * | 6/2017 | Yabuya | A44L 319/262 |

FOREIGN PATENT DOCUMENTS

| | | | |
|---|---|---|---|
| JP | 11-89612 | A | 4/1999 |
| JP | 2006-15069 | A | 1/2006 |
| JP | 2008-036280 | A | 2/2008 |
| JP | 2009-56076 | A | 3/2009 |
| WO | 2010/070744 | A | 6/2010 |
| WO | 2011/145183 | A1 | 11/2011 |

OTHER PUBLICATIONS

Supplementary European Search Report, European Patent Application No. 12876492.5, dated Nov. 11, 2015.

* cited by examiner

SLIDER FOR SLIDE FASTENER

This application is a national stage application of PCT/JP2012/061754, which is incorporated herein by reference.

TECHNICAL FIELD

The invention relates to a slider for a slide fastener, and more particularly, to a slider whose fastener tape is less prone to be damaged even if sliding motion is repeated on the slide fastener.

BACKGROUND ART

Conventionally, a slide fastener is used for opening and closing openings of various articles such as clothes and bags. Generally, the slide fastener includes a pair of left and right fastener stringers in which element rows are formed along opposed tape-side edges of left and right fastener tapes, and a slider inserted into the element rows. By sliding a slider in a coupling direction or a separating direction of fastener elements along the element rows, the slide fastener can be closed or opened.

There exist various kinds of sliders used for the slide fastener having different structures and functions. As typical types of sliders, there are known a slider having a locking mechanism by means of a locking pawl, and a free slider having no locking mechanism.

As the slider having the locking mechanism, a slider disclosed in WO 2010/70744 A (Patent Document 1) is known.

For example, the slider described in Patent Document 1 includes a slider body to which shoulder-opening-side tip portions (front ends) of upper and lower wing plates are connected through a diamond, a tab turnably held by the slider body, and a locking pawl provided at its one end with a pawl.

Placed on the upper wing plate of the slider body in Patent Document 1 are left and right tab holding portions for holding the tab, an insertion groove into which the locking pawl is inserted, a swaging portion to which the other end of the locking pawl is swaged and fixed, and a pawl hole into which a pawl of the locking pawl is inserted and through which the pawl projects into an element guide path. An upper flange is suspended toward a lower wing plate from left and right side edges of an upper wing plate in the slider body, and a lower flange stands toward an upper wing plate from left and right side edges of the lower wing plate.

In Patent Document 1, a shaft of the tab is provided with a cam portion having a cam-shaped cross section. The locking pawl is attached to the slider body by swaging and fixing the other end of the locking pawl to the slider body by a swaging portion of the slider body in a state where the pawl of the locking pawl is inserted into the pawl hole of the upper wing plate and the shaft of the tab is covered from above.

In the slider having such a locking pawl, in a state where the slider is not slid and the tab inclines toward a rear opening of the slider, the pawl of the locking pawl projects into the element guide path of the slider body and engages with the element rows. Therefore, the slider is prevented from freely sliding with respect to the element rows, and a stopped state of the slider is maintained.

When the tab is made to stand from the inclined state to slide the slider, the cam portion placed on the shaft of the tab brings up the locking pawl to pull the pawl out from the element guide path. Therefore, the engagement between the pawl and the element rows is released, and the slider can smoothly slide along the element rows.

The fastener stringer having no locking mechanism is disclosed in JP 11-89612 A (Patent Document 2) for example. The slider described in this Patent Document 2 includes a slider body to which front ends of upper and lower wing plates are connected through a diamond, and a tab turnably held on the slider body.

A tab attaching post is integrally formed, in a cantilever manner, on the upper wing plate of the slider body in Patent Document 2. A space into which a shaft of the tab can be inserted is provided between a tip (free end) of the tab attaching post and the upper wing plate. The tab is attached to the slider body by plastically deforming the tab attaching post such that the space between the tip of the tab attaching post and the upper wing plate is narrowed after the shaft of the tab is inserted between the tab attaching post and the upper wing plate through the space.

Also in the slider body of Patent Document 2, an upper flange is suspended toward the lower wing plate from left and right side edges of the upper wing plate, and a lower flange stands toward the upper wing plate on left and right side edges of the lower wing plate.

At present, uses and intended purposes of the slide fastener are very wide, and various types of slide fasteners having different structures and functions are used in accordance with respective uses and intended purposes.

A so-called normal type slide fastener is widely used for clothes and bags. In the case of this normal type slide fastener, element rows are placed on a tape-side edge on the side of a first tape face (tape surface) which is exposed outside of a fastener tape, and the element rows are formed by attaching fastener elements of the element rows to the tape-side edge in a state where coupling heads of the fastener elements project outward from a tape-side end edge.

Hence, according to the normal type slide fastener, at least portions of the fastener elements can be seen from outside when the left and right element rows are coupled to each other. For such a normal type slide fastener, the sliders described in Patent Documents 1 and 2 are used.

In contrast with such a normal type slide fastener, there are known a hiding type slide fastener and a back-side using type slide fastener as slide fasteners in which fastener elements are hidden so that they cannot be seen from outside when the left and right element rows are coupled to each other.

In the hiding type slide fastener (hereinafter, simply referred to as "hiding-slide fastener"), a fastener element is attached to a first tape face of an element attaching portion in a state where a coupling head of the fastener element is directed to a tape main body with respect to a band-shaped fastener tape and thereafter, the fastener tape is bent into a substantially U-shape at a boundary between the tape main body and the element attaching portion such that a second tape face comes inside, and the coupling head projects outward from a tape bending portion of the fastener tape, thereby configuring a fastener stringer for the hiding-slide fastener.

Two fastener stringers configured in this manner are combined with each other, sliders as described in JP 2006-15069 A (Patent Document 3) for example are inserted into left and right element rows, and the hiding-slide fastener is configured. According to such a hiding-slide fastener, when left and right element rows are coupled to each other, tape bending portions of left and right fastener tapes come into close contact with each other. According to this, the coupled element rows are covered with and hidden by the fastener tapes so that the element rows cannot be seen from outside.

According to the back-side using type slide fastener, element rows are placed on tape-side edge of a second tape face (tape back face) which is not exposed outside of fastener tapes. When the left and right element rows are coupled to each other, opposed tape-side edges of left and right fastener tapes come into close contact with or approach each other. According to this, the coupled element rows are covered with and hidden by the fastener tapes so that the element rows cannot be seen from outside. One example of a slider used for such a back-side using type slide fastener is described in JP 2009-56076 A (Patent Document 4).

CITATION LIST

Patent Documents

Patent Document 1: WO 2010/70744 A
Patent Document 2: JP 11-89612 A
Patent Document 3: JP 2006-15069 A
Patent Document 4: JP 2009-56076 A

SUMMARY OF INVENTION

Technical Problem

According to the above-described various kinds of slide fasteners, when a slider slides along the element rows, the slider easily comes into contact with fastener tapes, and friction easily develops between the slider and the fastener tapes. Especially when the slide fastener is attached to a bag or the like, to slide the slider, a sliding operation of the slider is carried out in many cases while pulling a tab of the slider.

Generally the tab is held on the upper wing plate of the slider body. Therefore, if the tab is pulled as described above, the slider slides while being pulled diagonally upward with respect to the fastener stringers. In this case, a lower flange placed on a lower wing plate of the slide, especially a ridge line placed between an a surface of the lower flange opposed to the upper wing plate and an outer surface of the lower flange easily comes into contact with the tape face of the fastener tape.

The lower flange easily comes into contact with the fastener tape of such a slider when the slider slides in the coupling direction of the element rows, i.e., when the slide fastener is closed while bringing left and right fastener elements into contact with upper and lower flanges of the slider and while pulling the left and right fastener stringers. In this case, a shoulder-opening-side tip portion of the lower flange mainly comes into contact with a tape face of the fastener tape.

However, in the conventional slider, the shoulder-opening-side tip portion of the lower flange has a shoulder-opening-side tip surface, an upper surface, an inner surface and an outer surface, and angular ridge lines are formed at boundaries between these surfaces in many cases. A peaked angle portion is formed, in some cases, on an outer surface of the shoulder-opening-side tip portion by three surfaces, i.e., the shoulder-opening-side tip surface, the upper surface and the outer surface.

When the slider is made to slide in the coupling direction of the element rows as described above, an angle portion on an outer surface and an upper surface of the shoulder-opening-side tip portion comes into sliding contact with the tape face of the fastener tape and thus, stress and a friction force easily concentrate on the tape portion against which the angle portion hits. Hence, if the sliding operation of the slider is repeated, the tape portion with which the shoulder-opening-side tip portion (especially angle portion of shoulder-opening-side tip portion) of the lower flange of the slider is gradually damaged and weakened, and if the slide fastener is used for a long term, threads configuring the fastener tape are partially cut and the fastener tape is broken in some cases.

As conventional sliders, there are known a slider in which a ridge line configured by a shoulder-opening-side tip surface and an upper surface in a lower flange is formed into a chamfered curved surface (see FIG. 9 in Patent Document 4, for example), and a slider in which a shoulder-opening-side tip surface in a lower flange is downwardly inclined toward the shoulder (see FIG. 1 in Patent Document 1, for example).

In the case of the slider in which the ridge line configured by the shoulder-opening-side tip surface and the upper surface in the lower flange is chamfered for example, as compared with a slider having an angled ridge line, when the slider is made to slide in the coupling direction of the element rows and the fastener tape comes into contact with the shoulder-opening-side tip portion of the lower flange, the fastener tape does not easily hook on the shoulder-opening-side tip portion of the lower flange and the slider can smoothly slide.

However, even if the ridge line of the lower flange is formed into a curved surface shape, when the slider is made to slide, especially when the slider is made to slide in the coupling direction (closing direction) of the element rows in a state where a strong laterally pulling force is applied to the fastener tape, the fastener tape strongly comes into local contact with an outer side of the ridge line and the fastener tape easily receives a large load. Therefore, the fastener tape is broken in some cases as in the above-described fastener tape.

In the case of the slider in which the shoulder-opening-side tip surface of the lower flange downwardly inclines toward the shoulder also, if the ridge line formed on the shoulder-opening-side tip portion of the lower flange is angular or if an angle portion of the outer surface side and the upper surface side of the shoulder-opening-side tip portion is peaked, when the slider is made to slide, especially when the slider is made to slide in the coupling direction of the element rows in a state where a strong laterally pulling force is applied to the fastener tape, the fastener tape receives large stress from the shoulder-opening-side tip portion of the lower flange. Therefore, when the sliding operation of the slider is repeated, the fastener tape is partially broken in some cases.

The invention has been accomplished in view of the conventional problems, and it is a specific object of the invention to provide a slider in which constituent threads of a fastener tape are not easily cut by contact between a lower flange and a fastener tape of the slider even if sliding operation of the slider is repeated, and it is possible to prevent the fastener tape from being broken.

Solution to Problem

To achieve the above object, the invention provides a slider for a slide fastener including a slider body and a tab held by the slider body, in which the slider body at least includes an upper wing plate from which a tab attaching post for holding the tab stands, a lower wing plate placed such that it is opposed to the upper wing plate, a diamond connecting a shoulder-opening-side tip portion of the upper wing plate and a shoulder-opening-side tip portion of the lower wing plate to each other, and left and right lower flanges extending from left and right side edges of the lower wing plate toward the upper wing plate, being characterized in that each of the lower flanges includes a downwardly inclined surface portion which is placed on the shoulder-opening-side tip portion on a side of an upper wing plate-opposed surface and on an outer side in a width direction of the slider, and which downwardly inclines toward a shoulder and downwardly inclines toward the outer side in the width direction of the slider.

In the slider according to the invention, each of the downwardly inclined surface portions is preferably placed such that it is adjacent to a tip surface on the side of the shoulder, the upper wing plate-opposed, and an outer surface through ridge lines. In this case, a region surrounded by the ridge lines of the downwardly inclined surface portion is preferably triangular in shape, and each of the ridge lines is preferably chamfered.

Further, in the slider according to the invention, the downwardly inclined surface portion preferably has a shape obtained by notching an angle on the side of the upper wing plate-opposed surface of the shoulder-opening-side tip portion and on the outer side in the width direction of the shoulder.

Further, in the slider according to the invention, each of left and right side edges the lower wing plate preferably includes a gradually increasing portion having a width size of the lower wing plate which is gradually increased toward a rear opening from the shoulder-opening-side tip portion to the rear opening, a parallel portion where the left and right side edges are parallel to each other, and a gradually reducing portion having the width size of the lower wing plate which is gradually reduced toward the rear opening, the lower flanges is preferably placed in a range from an end edge of the lower wing plate on a side of the rear opening to a region of a portion of the parallel portion, and the downwardly inclined surface portion is preferably placed in a region of the parallel portion.

Furthermore, in the slider according to the invention, each of the lower flanges preferably has a width-increased portion in which a size of a straight line connecting an outer edge and an inner edge of the lower flange to each other at shortest is gradually increased toward the shoulder.

Further, the downwardly inclined surface portion is preferably placed such that it can be seen from a side of the slider.

Further, in the slider according to the invention, the slider body preferably has left and right upper flanges extending from left and right side edges of the upper wing plate toward the lower wing plate, and the upper flange preferably includes an upwardly inclining surface portion which is placed on the shoulder-opening-side tip portion on a side of its surface opposed to the lower wing plate and on the outer side in the width direction of the slider, and which upwardly inclines toward the shoulder and upwardly inclines toward the outer side in the width direction of the slider.

In this case, the upwardly inclining surface portion is preferably plane-symmetric with respect to the downwardly inclined surface portion.

Advantageous Effect of Invention

According to a slider for a slide fastener of the invention, lower flanges respectively stand on left and right side edges of a lower wing plate, a downwardly inclined portion including an inclined surface which downwardly inclines toward a shoulder and outward in a width direction of the slider is formed on the side of a surface of a shoulder-opening-side tip portion (front end) in each of the lower flange opposed to an upper wing plate and on an outer side in the width direction of the slider.

The downwardly inclined portion is formed on the shoulder-opening-side tip portion in the lower flange of the slider in this manner. Therefore, when the slider of the invention is made to slide in a coupling direction of element rows in the slide fastener for example, it is possible to bring the fastener tape and a surface (inclined surface) of the downwardly inclined portion of the lower flange into contact with each other, and a contact area where the lower flange and the fastener tape come into contact with each other can be increased as compared with conventional sliders.

According to this, the fastener tape hits on the shoulder-opening-side tip portion of the lower flange and a load (stress) received by the fastener tape is dispersed, and it is possible to prevent the load from locally concentrating unlike the conventional technique. Therefore, even if a sliding operation of the slider of the invention is repeated for a long term of the slide fastener, the fastener tape is less prone to be damaged by the lower flange of the slider, it is possible to prevent the fastener tape from being broken and to extend the life of the fastener tape as compared with the conventional technique.

In the slider of the invention, the downwardly inclined surface portion is placed in adjacent to a tip surface (front surface) of the lower flange on the side of the shoulder, a surface (upper surface) of the lower flange opposed to the upper wing plate and an outer surface of the lower flange through the ridge line. Especially, a region of the downwardly inclined surface portion surrounded by the ridge line is triangular in shape. Since the downwardly inclined surface portion is formed in this manner, when the slider slides, the fastener tape can stably come into contact with the downwardly inclined surface portion of the lower flange and thus, it is possible to effectively prevent the fastener tape from being broken.

In this case, since the ridge line is formed into the chamfered curved surface shape, stress received by the fastener tape from the ridge line can be moderated also when the slider slides in the coupling direction, it is possible to prevent the fastener tape from hooking on the lower flange, and to smoothly slide the slider.

In the slider of the invention, the downwardly inclined surface portion has such a shape that an angle portion on a side of the surface of the shoulder-opening-side tip portion opposed to the upper wing plate and on the outer side in the width direction of the slider is notched. According to this, when the slider slides, since the fastener tape can stably come into contact with the downwardly inclined surface portion of the lower flange, and it is possible to more effectively prevent the fastener tape from being broken.

In the slider of the invention, each of left and right side edges of the lower wing plate include a gradually increasing portion extending from the shoulder-opening-side tip portion toward a rear opening in which a width of the lower wing plate is gradually increased toward the rear opening, a parallel portion where the left and right side edges are parallel to each other, and a gradually reducing portion in which the width of the lower wing plate is gradually reduced. The lower flange extends from an end edge of the lower wing plate on the side of the rear opening to a portion of a region of the parallel portion from at least a portion of the parallel portion of the lower wing plate and the gradually reducing portion, and the downwardly inclined surface portion is provided in a region of the parallel portion of the lower wing plate in the lower flange.

Since the downwardly inclined surface portion of the lower flange is provided in the region of the parallel portion of the lower wing plate, it is possible to stably form the downwardly inclined surface portion having a desired size in the region with which the fastener tape of the lower flange easily comes into contact.

In the slider of the invention, the lower flange has a width-increased portion where a size of a straight line connecting an outer edge and an inner edge of the lower flange to each other at the shortest is gradually increased toward the shoulder. According to this, since the shoulder-opening-side tip portion of the lower flange is largely formed, the downwardly inclined surface portion can more largely be formed on the shoulder-opening-side tip portion, and the downwardly inclined surface portion can be formed at a desired inclining angle.

In the slider of the invention, the downwardly inclined surface portion is placed such that it can be seen from a front view from side of the slider. That is, the downwardly inclined surface portion of the invention is placed in an outer direction of the slider in the width direction. Therefore, when the slider is made to slide in the coupling direction of the element rows and the slide fastener is closed while pulling the left and right fastener stringers, the fastener tape can stably come into contact with the downwardly inclined surface portion of the lower flange.

In the slider of the invention, the left and right side edges of the upper wing plate of the slider body include left and right upper flanges extending toward the lower wing plate. The upper flanges are placed on the side of a surface of the shoulder-opening-side tip portion opposed to the lower wing plate and on the outer side in the width direction of the slider, and include upwardly inclining surface portions which upwardly incline toward the shoulder and upwardly incline outward in the width direction of the slider. Especially in this case, the upwardly inclining surface portion placed on the upper flange has a shape which is symmetric with respect to a plane with the downwardly inclined surface portion placed on the lower flange.

The upwardly inclining surface portion is formed on the upper flange of the slider in this manner. According to this, if the fastener tape comes into contact with the upper flange when the slider of the invention is made to slide in the coupling direction of the element rows in the slide fastener, it is possible to bring the fastener tape and a surface (inclined surface) of the upwardly inclined portion of the upper flange into contact with each other. Therefore, like the case of the downwardly inclined portion of the lower flange, the fastener tape hits on the shoulder-opening-side tip portion and a load (stress) received by the fastener tape can easily be dispersed.

Therefore, even if the slide fastener is used for a long term and the sliding operation of the slider of the invention is repeated, the fastener tape is less prone to be damaged not only by the lower flange of the slider but also by the upper flange. Therefore, it is possible to more effectively prevent the fastener tape from being broken.

DESCRIPTION OF EMBODIMENT

Example 1

Figure 6:
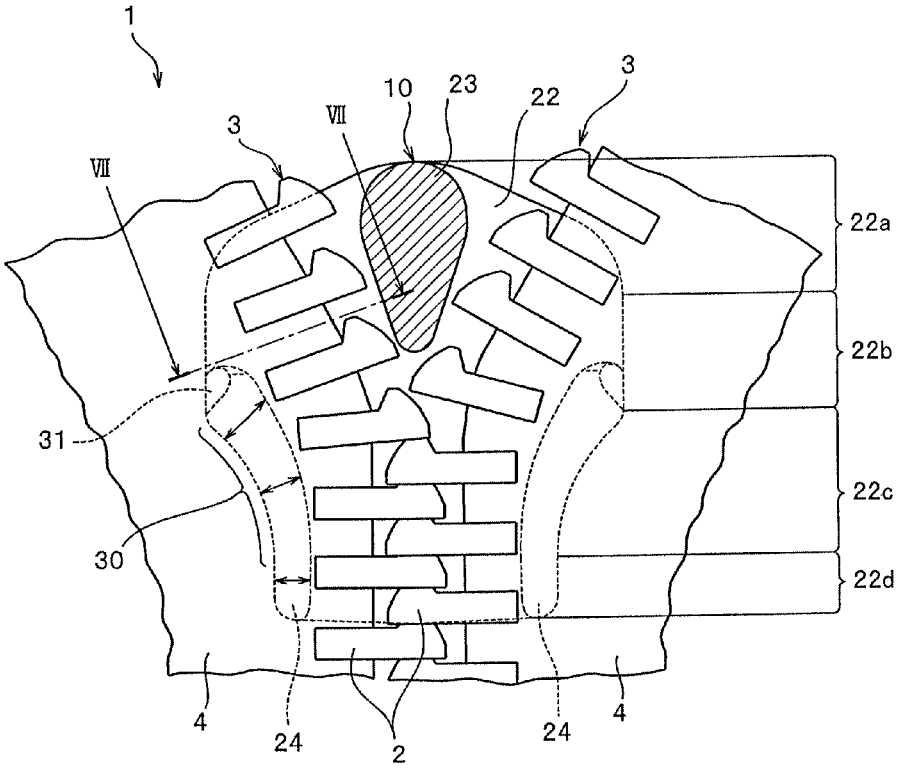
FIG. 6 is a sectional view showing a relation between the slider and left and right fastener stringers.
Figure 7:
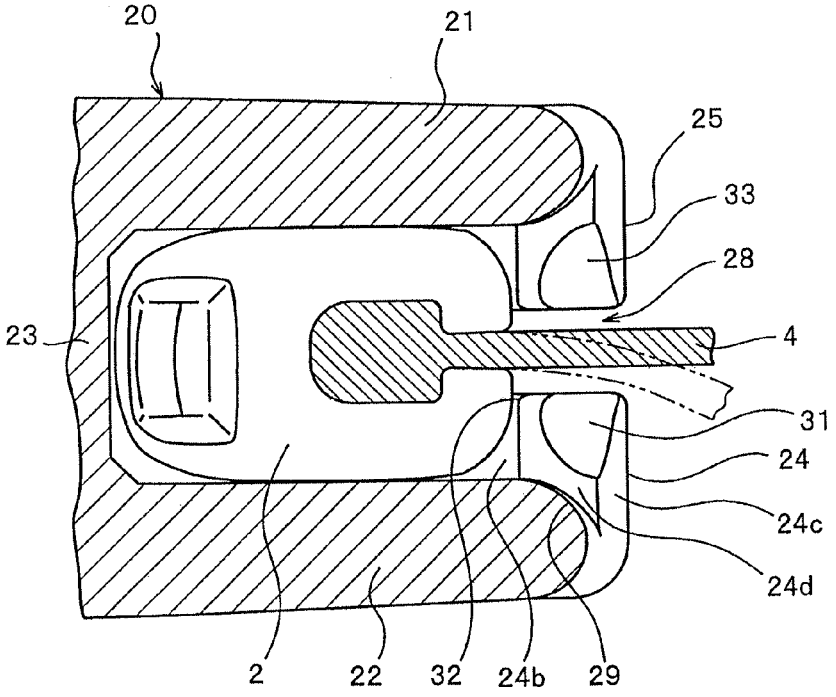
FIG. 7 is a sectional view taken along line VII-VII in FIG. 6.

A slider 10 according to Example 1 is used for a slide fastener 1 in which a plurality of metal fastener elements 2 as shown in FIG. 6 are attached to left and right fastener tapes 4. By sliding the slider 10 in a separating direction or a coupling direction along element rows 3 of the fastener elements 2, the slide fastener 1 is opened and closed. The slide fastener 1 having the slider 10 with a tab 11 of Example 1 is attached to an opening or an opening/closing portion of a fastener-attached body such as a bag 5 shown in FIG. 1 for example, to be used.

Figure 2:
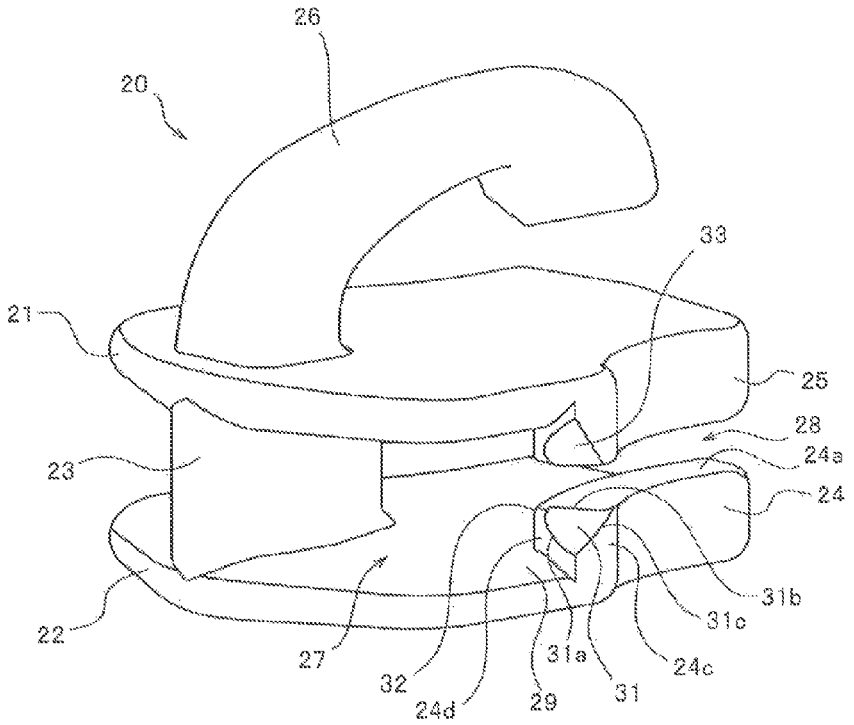
FIG. 2 is a perspective view of a slider body in the slider.
Figure 3:
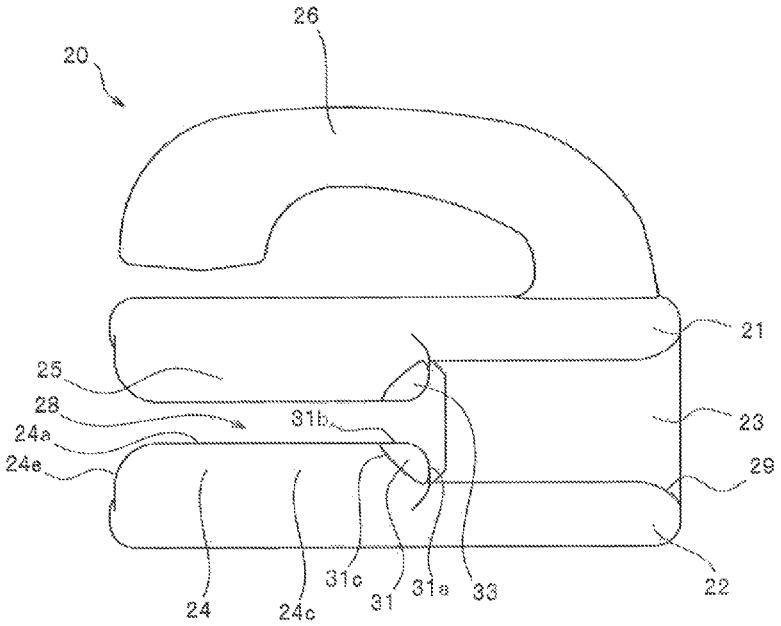
FIG. 3 is a side view of the slider body.
Figure 4:
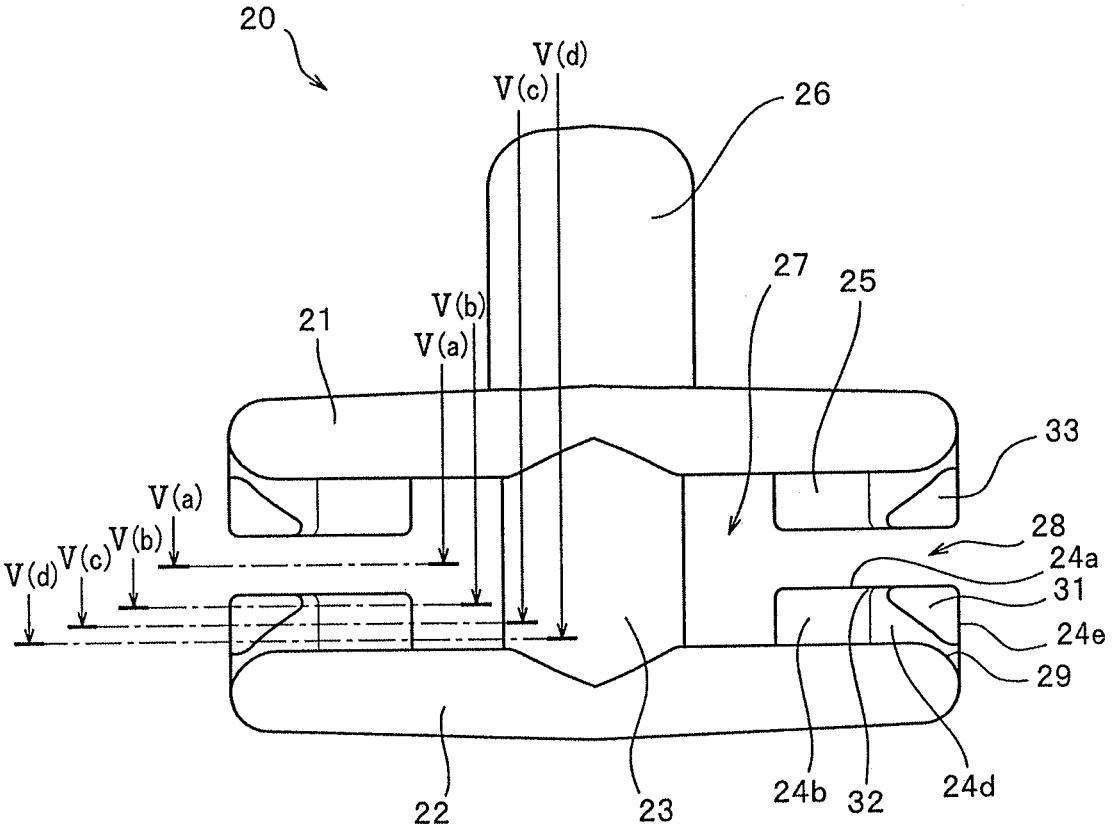
FIG. 4 is a front view of the slider body.

A configuration of the slider 10 according to Example 1 will be described in detail with reference to the drawings. Here, FIGS. 2 to 4 are respectively a perspective view, a side view and a front view showing a slider body 20 of the slider 10 in Example 1. FIG. 2 shows the slider body 20 before a later-described tab attaching post 26 is swaged for holding a tab 11, and FIGS. 3 and 4 show the slider body 20 after the tab attaching post 26 is swaged.

In the following description, a longitudinal direction of the slider 10 means a direction (length direction of slider 10) which is parallel to a sliding direction of the slider 10 when the slide fastener 1 is configured, a sliding direction when the slider 10 is made to slide to couple the left and right element rows 3 to each other is defined as a front direction (direction toward shoulder), and a sliding direction when the slider 10 is made to slide such that the left and right element rows 3 are separated from each other is defined as a rear direction (direction toward rear opening).

A vertical direction of the slider 10 means a height direction of the slider 10, a direction where the tab 11 is attached to the slider body 20 is defined as an upward direction, and a direction opposite from the height direction is defined as a downward direction. A lateral direction of the slider 10 is a direction intersecting with the sliding direction of the slider 10 at right angles, and this direction is a width direction of the slider 10.

The slider 10 of Example 1 includes the slider body 20 and the tab 11. The slider body 20 and the tab 11 are formed by die casting from metal material such as aluminum alloy and zinc alloy, or by press working from metal plate such as copper alloy. In the invention, materials and producing methods of the slider body 20 and the tab 11 are not especially limited, and they can freely be selected.

The tab 11 in Example 1 includes a knob portion, a pair of left and right arm portions extending from one end of the knob portion, and an attaching shaft portion connecting tips of the arm portions to each other, and a conventionally generally used tab can be used as the tab 11.

The slider body 20 in Example 1 has a laterally symmetric shape with respect to a center line of the width direction of the slider. The slider body 20 includes an upper wing plate 21, a lower wing plate 22 separated from the upper wing plate 21 and opposed to the upper wing plate 21, a diamond 23 connecting front ends (shoulder-opening-side tip portions) of the upper and lower wing plates 21 and 22 to each other, left and right lower flanges 24 standing from left and right side edges of the lower wing plate 22, left and right upper flanges 25 suspended from left and right side edges of the upper wing plate 21, and the tab attaching post 26 standing from an upper surface of the upper wing plate 21.

Left and right shoulders are formed on a front end of the slider body 20 such that the diamond 23 is sandwiched between the left and right shoulders. A rear opening is formed in a rear end of the slider body 20. In this case, the left and right shoulders are placed between a front end of the diamond 23 in the slider body 20 and front ends of the left and right upper and lower flanges 25 and 24. The rear opening is placed between rear ends of the left upper and lower flanges 25 and 24 and rear ends of the right upper and lower flanges 25 and 24.

The upper wing plate 21 and the lower wing plate 22 in Example 1 are parallel to each other, and are symmetric with respect to a plane. A Y-shaped element guide path 27 is formed between the upper and lower wing plates 21 and 22 for bringing the left and right shoulders and the rear opening into communication with each other.

Inclined surfaces or curved surfaces 29 are formed on a shoulder-opening-side tip portion in an inner surface of the upper wing plate 21 (surface of upper wing plate 21 opposed to lower wing plate 22) and in an inner surface of the lower wing plate 22 (surface of the lower wing plate 22 opposed to upper wing plate 21). The inclined surfaces or the curved surfaces 29 are formed such that thicknesses of the upper wing plate 21 and the lower wing plate 22 are gradually reduced outward so that the fastener elements 2 can easily be inserted into the element guide paths 27.

Further, tape insertion gaps 28 are formed between the left and right lower flanges 24 and the left and right upper flanges 25. The fastener tapes 4 are inserted into the tape insertion gaps 28 when the slide fastener 1 is configured. In this case, an upper surface 24*a* of the lower flange 24 and a lower surface of the upper flange 25 are placed in parallel to each other, and a gap of the tape insertion gap 28, i.e., a gap between the upper surface 24*a* of the lower flange 24 and the lower surface of the upper flange 25 has a constant size.

Each of left and right side edges of the lower wing plate 22 includes a gradually increasing portion (first side edge) 22*a* in which a size (width size) in the width direction of the slider of the lower wing plate 22 is gradually increased from its front end toward its rear end when the lower wing plate 22 is viewed from the upper surface or the lower side (see FIG. 6), a parallel portion (second side edge) 22*b* placed closer to the rear opening than the gradually increasing portion 22*a* and having a constant width of the lower wing plate 22, a gradually reducing portion (third side edge) 22*c* placed closer to the rear opening than the parallel portion 22*b* and having a gradually reducing width of the lower wing plate 22, and a rear opening side end (fourth side edge) 22*d* placed further closer to the rear opening than the gradually reducing portion 22*c* and having a constant width of the lower wing plate 22.

In this case, the left and right side edges of the lower wing plate 22 in the parallel portion 22*b* and the rear opening side end 22*d* are parallel to each other. Like the lower wing plate 22, each of the left and right side edges of the upper wing plate 21 includes a gradually increasing portion (first side edge), a parallel portion (second side edge), a gradually reducing portion (third side edge), and a rear opening side end (fourth side edge), and these members are located in this order from a front end side of the upper wing plate 21.

The left and right lower flanges 24 in Example 1 are formed in a range from the rear end of the lower wing plate 22 to a region of the rear end of the parallel portion 22*b* along the left and right outer edges of the lower wing plate 22, and the lower flange 24 does not extend to a front end region of the parallel portion 22*b*.

The lower flange 24 includes the upper surface 24*a* opposed to the upper wing plate 21 (especially upper flange 25), an inner surface 24*b* placed on the side of the element guide path 27 of the lower flange 24 such that the inner surface 24*b* intersects with the upper surface 24*a* at right angles through a ridge line, an outer surface 24*c* placed on the side of an outer edge of the lower flange 24 such that the outer surface 24*c* intersects with the upper surface 24*a* at right angles through a ridge line, a front end surface 24*d* placed on a front end of the lower flange 24, and a rear end surface 24*e* placed on a rear end of the lower flange 24.

The inner surface 24*b* of the lower flange 24 stands from the lower wing plate 22 such that the inner surface 24*b* is opposed to the element rows 3 inserted into the element guide paths 27, and the outer surface 24*c* stands along the outer edge of the lower wing plate 22. The front end surface 24*d* of the lower flange 24 is an end surface including a surface directed to a front portion of the slider (surface which is parallel to width direction of slider), and the front end surface 24*d* is adjacent to the inner surface 24*b* and the outer surface 24*c* through a ridge line.

Figure 5:
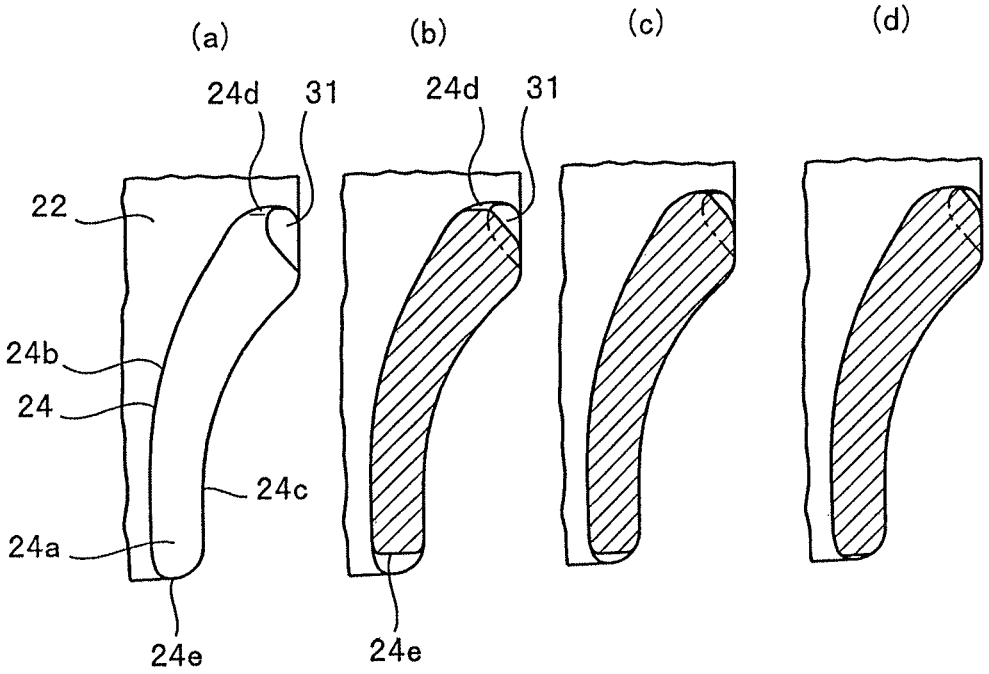
FIGS. 5(*a*) to 5(*d*) are sectional views taken along line V(a)-V(a) to line V(d)-V(d) in FIG. 4.

In this invention, the front end surface 24*d* of the lower flange 24 may be formed continuously from the inner surface 24*b* and/or the outer surface 24*c* without through a ridge line. In this case, when a cross section of the lower flange 24 is viewed from a direction intersecting with the vertical direction at right angles is seen as shown in FIG. 5 for example, the front end surface 24*d* means an end surface including a surface which is parallel to the width direction of the slider and a surface from an outer side end of the parallel surface to the outer edge of the lower wing plate 22, or the front end surface 24*d* means an end surface formed from a front end of the lower flange 24 to the outer edge of the lower wing plate 22 when the cross section is seen. In the lower flange of the invention, the inner surface 24*b* and the outer surface 24*c* of the lower flange 24 may be adjacent to each other through a ridge line and the lower flange may not be provided with a front end surface.

The ridge line between the upper surface 24*a* and the inner surface 24*b* and the ridge line between the upper surface 24*a* and the outer surface 24*c* in the lower flange 24 of Example 1 are formed into curved surfaces having relatively large curvatures. The ridge lines between the rear end surface 24*e*, the upper surface 24*a*, the inner surface 24*b* and the outer surface 24*c* in the lower flange 24 are formed into chamfered curved surfaces which are curved with a curvature smaller than that of the ridge line between the upper surface 24*a*, the inner surface 24*b* and the outer surface 24*c*.

As shown in FIG. 6, the lower flange 24 of Example 1 has a width-increased portion 30 in which a size (lateral size of lower flange 24, hereinafter) of a straight line connecting the inner surface 24*b* (inner edge) and the outer surface 24*c* (outer edge) of the lower flange 24 to each other at the shortest is gradually increased toward the shoulder. Although it is only necessary that the width-increased portion 30 is placed on at least a portion of the lower flange 24, it is preferable that an entire portion of the lower flange 24 placed in a region of the gradually reducing portion 22*c* of the lower wing plate 22 is configured as the width-increased portion 30 as in Example 1.

Since the lower flange 24 has such a width-increased portion 30, it is possible to easily increase the lateral size of the front end (shoulder-opening-side tip portion) of the lower flange 24. Therefore, it is possible to stably provide a later-described downwardly inclined portion of a predetermined size on this front end at a predetermined inclination angle.

In this case, since a position of the outer surface 24*c* of the lower flange 24 is set closer to the outer side in the width direction of the slider toward the shoulder as compared with a conventional slider, it is possible to easily form the width-increased portion 30 on the lower flange 24 without largely changing a position of the inner surface 24*b* of the lower flange 24 as compared with the conventional slider, i.e., without largely changing a shape and a side of the element guide path 27 in the slider body 20 as compared with the conventional slider. Hence, when the slide fastener 1 is configured using the slider 10 of Example 1, it is possible to stably couple and separate the left and right element rows 3 to and from each other by sliding the slider 10.

Downwardly inclined surface portions 31 are formed on front ends of the left and right lower flanges 24. Each of the downwardly inclined surface portions 31 has a flat surface which downwardly inclines toward a front portion of the slider and downwardly inclines outward in the width direction of the slider. In other words, a height size (size in vertical direction) of the lower flange 24 is gradually reduced toward the front portion of the slider and is gradually reduced outward in the width direction of the slider at a portion of the lower flange 24 where the downwardly inclined surface portion 31 is formed.

In the invention, the downwardly inclined surface portion formed on the lower flange may include, instead of the above-described downwardly inclined flat surface, a curved surface close to a flat surface which is slightly curved into a convex form such that it downwardly inclines in the same direction (for example, curved surface having curvature smaller than those of ridge lines 31*b*, 31*c*, 31*a* which respectively define the inclined surface of the later-described downwardly inclined surface portions 31 and upper surface 24*a*, outer surface 24*c* and front end surface 24*d* of lower flange 24).

The left and right downwardly inclined surface portions 31 are placed on the side of the upper surface 24*a* and the outer surface 24*c* in the front ends of the left and right lower flanges 24. Each of the downwardly inclined surface portions 31 is placed in a region where the parallel portion (second side edge) 22*b* of the lower wing plate 22 is formed concerning a position in a length direction (longitudinal direction) of the slider, i.e., the downwardly inclined surface portion 31 is placed in front of a boundary between the parallel portion 22*b* and the gradually reducing portion 22*c* in the lower wing plate 22.

The downwardly inclined surface portion 31 has a notched shape which is formed by notching an outer angle portion formed on a front end of the lower flange 24 by three surfaces, i.e., the upper surface 24*a*, the outer surface 24*c* and the front end surface 24*d* of the lower flange 24. The inclined surface (flat surface) of the downwardly inclined surface portion 31 is adjacent to the upper surface 24*a*, the outer surface 24*c* and the front end surface 24*d* of the lower flange 24 through the ridge lines 31*b*, 31*c*, 31*a*, and is placed at a position separated from the inner surface 24*b* of the lower flange 24.

In this case, the ridge lines 31*b*, 31*c*, 31*a* which define the inclined surface of the downwardly inclined surface portion 31, the upper surface 24*a*, the outer surface 24*c* and the front end surface 24*d* of the lower flange 24 are formed into chamfered curved surfaces having large curvatures. A shape of the inclined surface (flat surface) surrounded by the ridge lines 31*b*, 31*c*, 31*a* in the downwardly inclined surface portion 31 has a substantially triangular shape which becomes thinner as its height position (position in vertical direction) becomes lower.

Concerning a height direction (vertical direction) of the slider 10, a lower end of each of the downwardly inclined surface portions 31 is set at a height position which is the same as that of a flat inner surface of the lower wing plate 22 excluding the inclined surface or the curved surface 29 formed on the shoulder-opening-side tip portion of the lower wing plate 22, or is set at a height position of a side higher than the height position of this inner surface. In the case of Example 1, the inclined surface or the curved surface 29 in which a thickness of the lower wing plate 22 is gradually reduced toward the outside is formed on the shoulder-opening-side tip portion in the inclined surface of the lower wing plate 22. Therefore, even if the lower end of the downwardly inclined surface portion 31 is set at the height position which is the same as the inner surface of the lower wing plate 22, it is separated from the lower wing plate 22.

The downwardly inclined surface portion 31 is placed at a position which can visually be seen when the slider 10 is seen from left and right sides (i.e., a side view of slider 10 is orthographically delineated as shown in FIG. 3) for example, and the downwardly inclined surface portion 31 is placed at a position which cannot visually be seen when the slider 10 and the lower flange 24 are seen from a center line in the width direction (i.e., when sectional view of slider 10 in center line of width direction thereof is delineated), for example.

On the other hand, an inner angle portion 32 formed by three surfaces, i.e., the upper surface 24*a*, the inner surface 24*b* and the front end surface 24*d* of the lower flange 24 is formed on the front end of the lower flange 24 on the side of the upper surface 24*a* and the inner surface 24*b* as shown in FIG. 4. However, the inner angle portion 32 does not have an angular shape, and is formed into a curved surface shape having a large curvature which is continuous with the upper surface 24*a*, the inner surface 24*b* and the front end surface 24*d* of the lower flange 24.

The left and right upper flanges 25 in Example 1 are formed in a range from the rear end of the upper wing plate 21 to the rear end of the parallel portion 22*b* along the left and right outer edges of the upper wing plate 21. Upwardly inclining surface portions 33 are formed on the front ends of the upper flanges 25 on the side of their lower surfaces and their outer surfaces. Each of the upwardly inclining surface portions 33 has a flat surface which upwardly inclines toward the front portion of the slider and which upwardly inclines outward in the width direction of the slider.

In the case of Example 1, the upper flange 25 and the upwardly inclining surface portion 33 formed on the upper flange 25 are plane-symmetric with respect to the lower flange 24 placed on the lower wing plate 22 and the downwardly inclined surface portion 31 formed on the lower flange 24. Therefore, specific description of the upper flange 25 and the upwardly inclining surface portion 33 will be omitted to avoid redundancy.

The tab attaching post 26 in Example 1 is integrally formed on the upper wing plate 21 on the side of its upper surface in a cantilever manner. A space is provided between a tip (free end) of the tab attaching post 26 and the upper wing plate 21, and the attaching shaft portion of the tab 11 can be inserted into the space. The tab 11 is attached to the slider body 20 by inserting a shaft of the tab 11 in between the tab attaching post 26 and the upper wing plate 21 through this space and then, by plastically deforming the tab attaching post 26 toward the upper wing plate 21 to narrow the space between the tip of the tab attaching post 26 and the upper wing plate 21.

According to the slider 10 of Example 1 having the above-described configuration, the slide fastener 1 is configured as shown in FIG. 6 by inserting the element rows 3 of the one set of left and right fastener stringers into the element guide paths 27 of the slider 10, and by slidably attaching the element guide paths 27 to the element rows 3.

Figure 1:
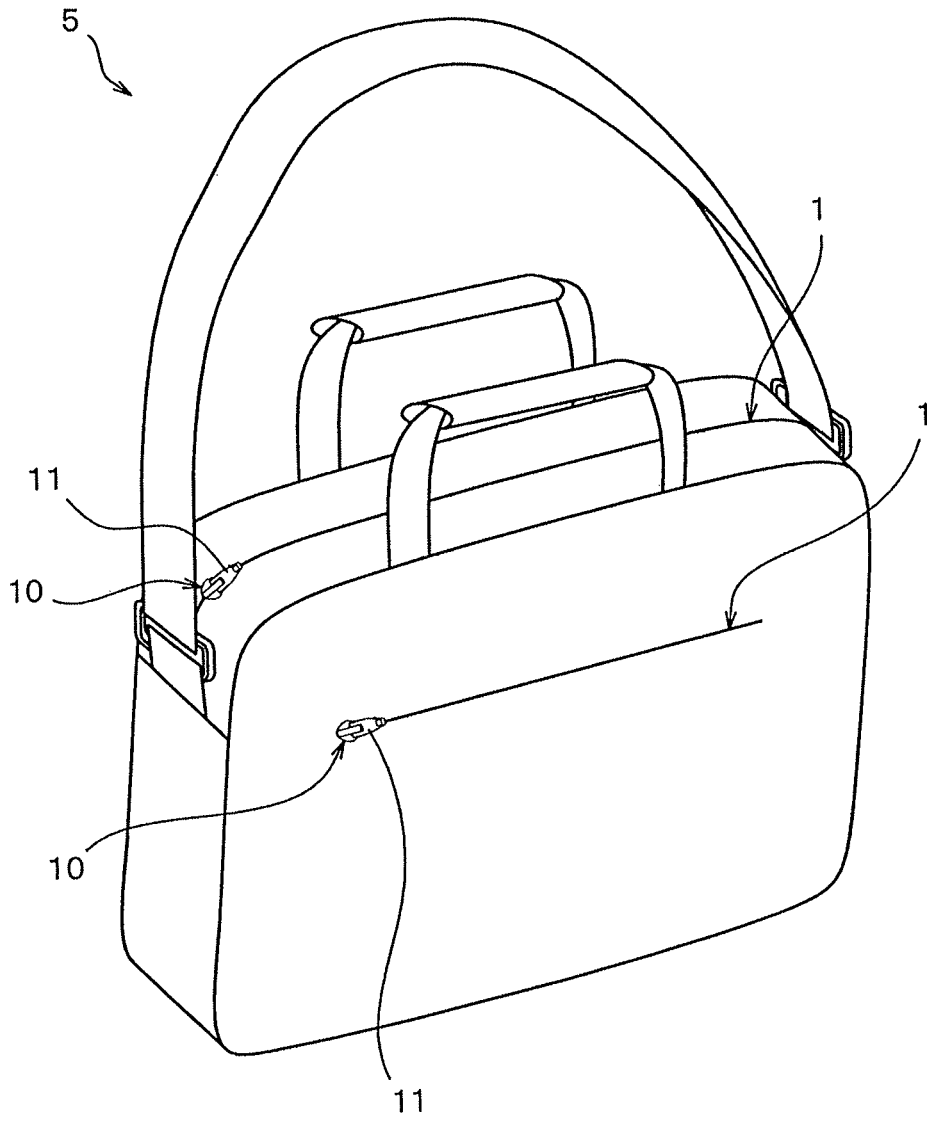
FIG. 1 is a perspective view showing a using example of a slide fastener having a slider according to Example 1 of the invention.

Assuming that the slide fastener 1 having the slider 10 of Example 1 is attached to an opening of the bag 5 shown in FIG. 1 for example and is used. When the slider 10 is made to slide in the coupling direction of the element rows 3, the fastener element 2 and the fastener tape 4 are made to sequentially enter in between the element guide path 27 and the tape insertion gap 28 from the shoulder of the slider body 20, the left and right fastener elements 2 are made to slide on the upper and lower flanges 25 and 24 of the slider body 20 to couple the fastener elements 2 to each other while pulling the left and right fastener stringers toward each other. According to this, the slide fastener 1 is closed.

In this case, to closer the opening of the bag 5, if a user slides the slider 10 while pulling the tab 11 of the slider 10 in the coupling direction diagonally upward with respect to the slider body 20 for example, since the entire slider 10 is upwardly pulled relative to the fastener tape 4, the slider 10 enters the tape insertion gap 28 of the slider body 20 while bending the fastener tape 4. Hence, the shoulder-opening-side tip portion (front end) of the lower flange 24 in the slider body 20, especially a portion of the shoulder-opening-side tip portion on the side of the upper surface 24*a* and on the outer side in the width direction comes into strong sliding contact with a tape back surface of the fastener tape 4.

At this time, since the shoulder-opening-side tip portions of the left and right lower flanges 24 in the slider 10 of Example 1 are provided with the downwardly inclined surface portions 31, even if the fastener tapes 4 come into sliding contact with the downwardly inclined surface portions 31, it is possible to prevent a load (stress) received by the fastener tapes 4 by contact with the shoulder-opening-side tip portions of the lower flanges 24 from locally concentrating. Hence, each of the fastener tapes 4 is less prone to be damaged by the shoulder-opening-side tip portion of the lower flange 24, and it is possible to prevent the fastener tape 4 from being broken.

When a user pulls the tab 11 of the slider 10 in the coupling direction while pushing the tab 11 toward the slider body 20 and slides the slider 10 for example, the shoulder-opening-side tip portion (front end) of the upper flange 25 in the slider body 20, especially a portion of the shoulder-opening-side tip portion on the side of its lower surface and on the outer side in the width direction comes into strong sliding contact with the tape surface of the fastener tape 4 in some cases.

Even in such a case, the shoulder-opening-side tip portion of the upper flange 25 in the slider 10 of Example 1 is provided with the upwardly inclining surface portion 33 as described above, it is possible to prevent a load (stress) received by the fastener tapes 4 by contact with the shoulder-opening-side tip portions of the upper flanges 25 from locally concentrating, and the fastener tape 4 can become less prone to be damaged like the case of the downwardly inclined surface portion 31 of the lower flange 24.

Therefore, according to the slide fastener 1 having the slider 10 of Example 1, even if the slide fastener 1 is used for a long term and the sliding operation of the slider 10 is repeated many times, it is possible to avoid defects that the lower flange 24 and the upper flange 25 of the slider 10 cut the constituent threads of the fastener tape 4 to break the fastener tape 4, and it is possible to further extend the life of the fastener tape 4.

Example 2

Figure 8:
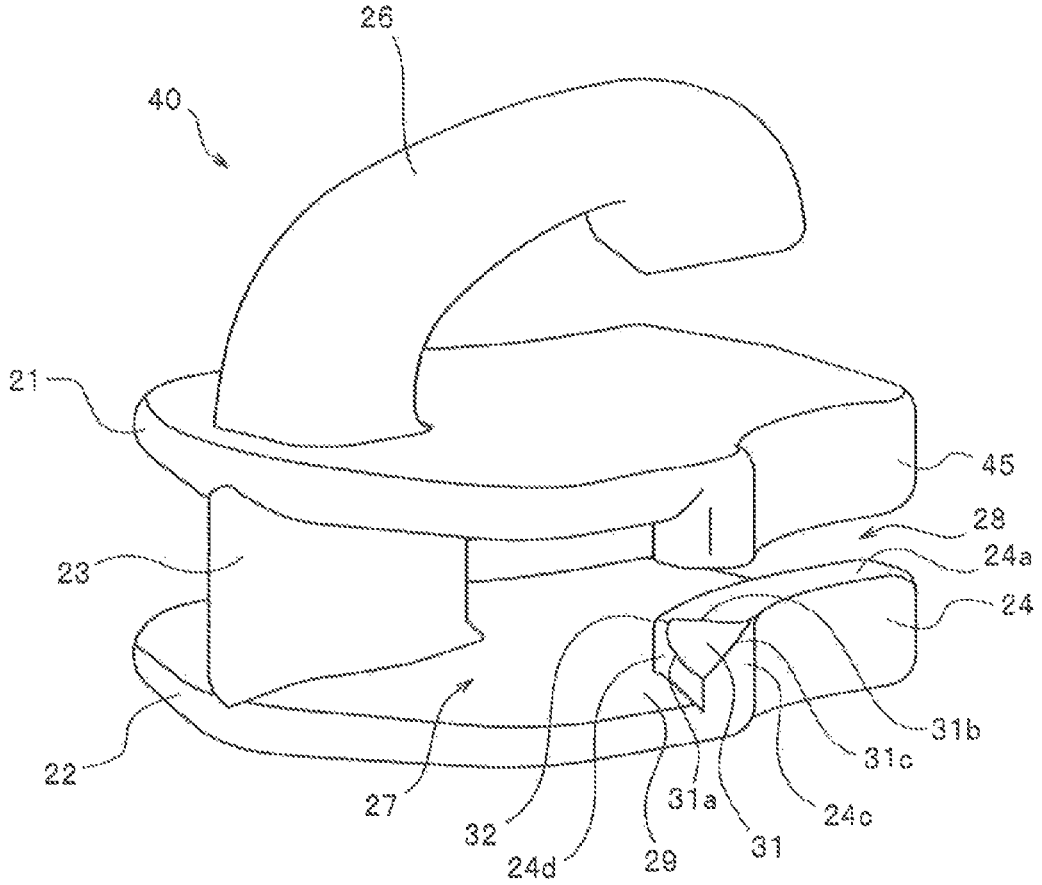
FIG. 8 is a perspective view showing a slider body of a slider according to Example 2 of the invention.

FIG. 8 is a perspective view showing a slider body 40 of a slider according to Example 2.

In Example 2, the same signs are allocated to parts and members having the same configurations as those of above-described Example 1, and descriptions thereof will be omitted.

Like the slider body 20 of above-described Example 1, in the slider body 40 in Example 2, shoulder-opening-side tip portions (front ends) of the lower flanges 24 suspended from left and right side edges of the lower wing plate 22 are provided with the downwardly inclined surface portions 31. On the other hand, shoulder-opening-side tip portions (front ends) of upper flanges 45 suspended from left and right side edges of the upper wing plate 21 are not provided with the upwardly inclining surface portions 33 which were formed on the slider body 20 of above-described Example 1.

That is, an outer angle portion formed by three surfaces, i.e., a lower surface, and outer surface and a front end surface of each of the upper flanges 45 is formed on the front end of the upper flange 45 of Example 2 on the side of its lower surface and on the side of the outer surface. The outer angle portion in the front end of the upper flange 45 does not have an angular shape but is formed into a chamfered curved surface shape which is continuous with the lower surface, the outer surface and the front end surface of the upper flange 45 and which has a large curvature.

A slide fastener is configured using the slider of Example 2. When the slide fastener is attached to the bag 5 shown in FIG. 1, even if a user slides a slider while pulling a tab 11 of the slider in the coupling direction diagonally upward with respect to the slider body 40 for example, the fastener tape 4 is less prone to be damaged even if it comes into contact with the shoulder-opening-side tip portion of the lower flange 24, and it is possible to prevent the fastener tape 4 from being broken like above-described Example 1.

The invention is not limited to specific embodiments of above-described Examples 1 and 2, and the invention can variously be modified only if substantially the same configurations as those of the invention are possessed and the same working effects as those of the invention can be exerted.

In above-described Examples 1 and 2, the slider 10 used for the slide fastener 1 in which the metal fastener element 2 is attached to the fastener tape 4 is described for example, kinds of the fastener element configuring the slide fastener are not especially limited.

For example, the slider of the invention can be used for a slide fastener having fastener elements which are independently formed one by one by means of injection molding of synthetic resin, and for a slide fastener having a continuous fastener element in which a monofilament has a coil shape or a zigzag shape.

Although the slider 10 of each of above-described Examples 1 and 2 is configured as a free slider having no locking mechanism, the slider of the invention can also be applied to a slider having a locking mechanism by a locking pawl.

Further, although the slider 10 of each of above-described Examples 1 and 2 is configured as a slider used for the so-called normal type slide fastener, the slider of the invention can also be applied to a slider for the hiding type slide fastener described in above-described Patent Document 3 and to a slider for the back-side using type slide fastener described in above-described Patent Document 4.

REFERENCE SIGNS LIST

1 Slide fastener
2 Fastener element
3 Element row
4 Fastener tape
5 Bag
10 Slider
11 Tab
20 Slider body
21 Upper wing plate
22 Lower wing plate
22*a* Gradually increasing portion (first side edge)
22*b* Parallel portion (second side edge)
22*c* Gradually reducing portion (third side edge)
22*d* Rear opening side end (fourth side edge)
23 Diamond
24 Lower flange
24*a* Upper surface
24*b* Inner surface
24*c* Outer surface
24*d* Front end surface
24*e* Rear end surface
25 Upper flange
26 Tab attaching post
27 Element guide path
28 Tape insertion gap
29 Curved surface
30 Width-increased portion
31 Downwardly inclined surface portion
32 Inner angle portion
33 Upwardly inclining surface portion
40 Slider body
45 Upper flange

The invention claimed is:

1. A slider for a slide fastener comprising a slider body and a tab coupled with the slider body, wherein the slider body at least comprises an upper wing plate from which a tab-attaching post extends, a lower wing plate opposed to the upper wing plate, a neck connecting a shoulder-opening-side tip portion of the upper wing plate and a shoulder-opening-side tip portion of the lower wing plate to each other, and left and right lower flanges extending from left and right side edges of the lower wing plate toward the upper wing plate, wherein:

each of the left and right lower flanges includes a flange upper surface that opposes the upper wing plate, a flange outer surface, a flange front end surface that faces the shoulder-opening-side-tip portion of the lower wing plate, and a downwardly inclined surface portion which downwardly inclines toward a shoulder of the slider and downwardly inclines toward an outer side of the slider in a width direction of the slider such that each downwardly inclined surface portion slopes downward in two different directions and a height in a vertical direction of each of the lower flanges is reduced along each downwardly inclined surface portion in (1) a length direction from the flange upper surface toward the shoulder of the slider and (2) the width direction from an inner portion of the slider toward the outer side of the slider, each of the downwardly inclined surface portions is bounded by three ridge lines and is triangular in shape, and a first of the three ridge lines of each triangularly shaped downwardly inclined surface portion is on one of the flange upper surfaces, a second of the three ridge lines of each triangularly shaped downwardly inclined surface portion is on one of the flange outer surfaces, and a third of the three ridge lines of each triangularly shaped downwardly inclined surface portion is on one of the flange front end surfaces and extends obliquely with respect to the one of the flange upper surfaces and the one of the flange outer surfaces to connect end portions of the first and the second of the three ridge lines.

2. The slider according to claim 1 wherein each of the downwardly inclined surface portions has a notched shape formed by an angle on one of the flange upper surfaces and on one of the flange outer surfaces in the width direction of the shoulder.

3. The slider according to claim 1 wherein:

each of the left and right side edges of the lower wing plate includes a gradually increasing portion having a width size of the lower wing plate which is gradually increased from the shoulder-opening-side tip portion of the lower wing plate toward a rear opening of the slider, a parallel portion where the left and right side edges of the lower wing plate are parallel to each other, and a gradually reducing portion in which the width size of the lower wing plate is gradually reduced toward the rear opening, the left and right lower flanges of the lower wing plate are placed from an end edge of the lower wing plate on a side of the rear opening to a region of the parallel portion, and each of the downwardly inclined surface portions is placed in a region of the parallel portion.

4. The slider according to claim 1 wherein each of the left and right lower flanges of the lower wing plate has a width-increased portion in which a length of a straight line connecting an outer edge to an inner edge of each of the left and right lower flanges is gradually increased toward the shoulder of the slider.

5. The slider according to claim 1 wherein the slider body has left and right upper flanges extending from left and right side edges of the upper wing plate toward the lower wing plate, and each of the left and right upper flanges of the upper wing plate includes an upwardly inclining surface portion that faces the lower wing plate and which upwardly inclines toward the shoulder of the slider and upwardly inclines toward the outer side of the slider in the width direction of the slider.

6. The slider according to claim 5 wherein each of the upwardly inclining surface portions is plane-symmetric with respect to a respective one of the downwardly inclined surface portions.

7. The slider for slide fastener of claim 1 wherein a first direction of the two different directions faces outward toward the outer side of the slider and a second direction of the two different directions faces frontward toward the shoulder-opening-side tip portion of the slider.

8. The slider for slide fastener of claim 1 wherein a first direction of the two different directions is the length direction and a second direction of the two different directions is the width direction.

* * * * *